US005584393A

United States Patent [19]

Korte

[11] Patent Number: 5,584,393

[45] Date of Patent: Dec. 17, 1996

[54] MERCHANDISE PACKAGE

[76] Inventor: Heinrich Korte, Am Rennschloot, 26810 Ihrhove, Germany

[21] Appl. No.: 292,183

[22] Filed: Aug. 19, 1994

[30] Foreign Application Priority Data

Aug. 28, 1993 [EP] European Pat. Off. ..... 93113791

[51] Int. Cl.[6] ..... B65D 73/00

[52] U.S. Cl. ..... 206/524.9; 206/756; 206/779; 206/702

[58] Field of Search ..... 206/45.14, 418, 206/461, 464, 465, 702, 756, 524.9, 779

[56] References Cited

U.S. PATENT DOCUMENTS

| | | | |
|---|---|---|---|
| 4,174,778 | 11/1979 | Klomp et al. . | |
| 4,279,376 | 7/1981 | Roccaforte | 206/45.14 |
| 4,353,461 | 10/1982 | Liang | 206/461 |
| 4,365,714 | 12/1982 | Doyel | 206/461 |
| 4,570,787 | 2/1986 | Forbes, Jr. | 206/461 |
| 5,263,586 | 11/1993 | Keable | 206/461 |
| 5,390,794 | 2/1995 | Vulpitta | 206/45.14 |

FOREIGN PATENT DOCUMENTS

| | | |
|---|---|---|
| 0541831 | 5/1993 | European Pat. Off. . |
| 9104097 | 6/1991 | Germany . |
| 7706511 | 12/1978 | Netherlands . |

*Primary Examiner*—David T. Fidei
*Attorney, Agent, or Firm*—McDermott, Will & Emery

[57] ABSTRACT

A merchandise package, in particular for long field lamps, having a stamped hole for taking up a merchandise holder, which has an outer area that can be folded into a box surrounding the merchandise to be packaged over at least part of its length, a head area that can be folded back on itself along a cross fold and has two stamped holes disposed mirror-symmetrically to the cross fold for taking up a merchandise holders, and an inner area adjacent the head area that can be folded back with the head area and in the finished package comes to lie within the box formed by the outer area and can be connected supportingly with the merchandise to be packaged.

13 Claims, 4 Drawing Sheets

MERCHANDISE PACKAGE

BACKGROUND OF THE INVENTION

1. Field of the Invention

The present invention relates to a material-saving merchandise package that is suitable in particular for elongate objects, for example lamps, and is provided with a stamped hole for taking up a merchandise holder.

2. Description of Related Art

Objects for daily use, including tools and materials for do-it-yourself work, are frequently offered in merchandise stands in self-service stores. Such merchandise stands have a bar on a rack or vertical wall onto which the packaged merchandise is slipped by means of a stamped hole or opening present in the package so that a prospective buyer can remove it in order to purchase it or look at it more closely. The merchandise is usually integrated firmly in the package, frequently by means of a transparent plastic film welded on a strip of material. Information about the product or its installation is found on the strip of material or welded in with the merchandise.

Due to recently passed or imminent legal regulations on reducing waste, which also provide in particular for the customer's disposal of unwanted packages, the conventional packaging concept proves to be frequently unsuitable. The reasons for this are mainly the use of compound materials and the use of plastics and/or great amounts of material. Compound materials cannot be properly sorted according to the type of material. Plastics are very difficult to reuse and can only be reused for the same purpose in very rare cases. The amount of packaging is a cost factor not only for production but also for further handling for purposes of reuse or disposal.

To comply with the legal requirements German industry and commerce have developed a disposal concept known as "The Green Dot" to encourage, among other things, sparing use of uniform packaging materials for products to be packaged. Fees are charged for disposal that depend on the size and type of package. The crucial aspects are that the merchandise be packaged in a material-saving way and the package not consist of compound materials, i.e. of interconnected heterogeneous materials that cannot be reused together, or of materials that are difficult to reuse.

Furthermore the extensive use of packaging materials and in particular plastics has fallen into disrepute not only due to the legal requirement of reuse but also due to consumers' increasing environment-consciousness, so that a tendency can be ascertained to use material-saving packages based on paper and cardboard.

A special problem is posed by the packaging of elongate objects, for example long field lamps, that require a relatively material-consuming package in relation to their volume, also with respect to the stabilization of the merchandise in the package. If the package envelops the merchandise altogether, considerable amounts of material are required. If the package envelops only part of the merchandise it is problematic to protect the merchandise from damage and to fix it in the package.

SUMMARY OF THE INVENTION

The invention is therefore based on the problem of providing a merchandise package that has a material-saving design and is suitable for packaging elongate objects. The package should do without compound materials and be made of materials that are homogeneous, returnable and reusable. Furthermore the package should be designed so that the merchandise can be fixed therein without difficulty even when it is not surrounded and supported by the package on all sides. At the same time the package and merchandise should be appealing in their presentation.

This problem is solved by a merchandise package of the abovementioned type having an outer area that can be folded into a box surrounding the merchandise to be packaged on all sides over at least part of its length, a head area that can be folded back on itself along a cross fold and has two stamped holes disposed mirror-symmetrically to the cross fold for taking up a merchandise holder, and an inner area that can be folded back with the head area and in the finished package comes to lie within the box and can be connected supportingly with the merchandise to be packaged.

The inventive merchandise package can be produced from cognate or uniform materials, which permits homogeneous collection and packaging and facilitates its use or reuse. Preferred materials are strong paper, cardboard or combinations thereof. The stamped hole present in the head area permits the packaged merchandise to be suspended on customary hanging merchandise stands. The outer area expediently comprises a bottom and two laterally adjacent side segments bordered laterally by a cover segment and a holding segment. The individual segments are delimited from one another by fold lines and can be closed into a box by suitable means.

It is also advantageous that the inventive merchandise package can be produced from an integral strip of material so that no space-consuming stock keeping is necessary. It can be stamped out of roll material, and also printed, on the spot. Customary cutting and stamping means can be used. But even when procured from a third party the as yet unfolded merchandise package can be easily stored in very little space. The merchandise package offers sufficient room for customary prints and product information that appear on the front in the customary place.

It is particularly advantageous that the inventive merchandise package need only be printed on one side; the other side is concealed from the viewer's eye in the finished package and therefore requires no lamination. This is because the finished merchandise package, after the head area is folded back with the adjacent inner area and the outer area is folded into the box with the inner area located within this box, presents to the consumer or viewer solely the printed side. Simultaneously the merchandise package gives the contained merchandise double support since the merchandise is supportingly held primarily by the inner area and is secured and protected additionally by the outer box. It is possible to integrate the merchandise in the package altogether but also to cover only part of elongate merchandise and let the rest protrude out of the folded box at the top and bottom.

The outer area of the inventive merchandise package can preferably be folded into a rectangular box that remains open at the lower end and lets the contained merchandise protrude at the bottom. The box can be assembled in any known way, for example by gluing, by bands, or by flaps and accordingly disposed slots that can lock together.

Side segments of the outer area continuing into the head area are expediently provided in the inventive merchandise package. This ensures firstly a stiffening of the merchandise package and thus greater durability of the package. Secondly it results in better protection for the contained merchandise at the sides and an improved hold of the merchandise in the package if the merchandise extends out of the box upward into the head area. The side segments of the outer area continuing into the head area are folded back with the upper part of the head area along the cross fold, thereby doubling the head area of the package and thus reinforcing the side wallings with the abovementioned effects. Alternatively the side segments can also end at the level of the cross fold, whereby there is no reinforcement of the side wallings.

The head area of the inventive merchandise package has customary stamped holes for taking up a merchandise holder in mirror-symmetric arrangement to the cross fold. When the head portion is folded back on itself along the cross fold the two symmetric stamped holes come to lie over each other, resulting in an opening extending uniformly through the back walling of the merchandise package which is double in this area.

According to an embodiment the inner area of the inventive merchandise package is equipped with one or more lateral belt- or band-shaped segments so that it can be guided around the merchandise to be packaged and the latter fixed therein. For this purpose flaps and slots, for example, are provided on the inner area, preferably in an arrangement whereby two flaps pointing away from each other are inserted in two slots and lead to a locking effect. Alternatively a lock can be obtained by guiding a flap around the merchandise, through a slot on the opposite side of the inner area and back into a further slot in the neck area of the flap.

With this belt- or band-shaped design of the inner area the resulting merchandise-securing belt cooperates in the package with a projection on the surface of the secured merchandise so that the merchandise hangs in the belt-shaped band. If the merchandise to be packaged is a long field lamp such a projection is frequently present in the bottom area in the form of a foot that serves to support and secure the lamp on a fastening surface. It is possible to secure the merchandise on the package in a different way, for example by frictional engagement or an adhesive strip that interconnects merchandise and package. Elements present on the merchandise, such as cables or suspensions, can also be wholly or partly integrated in the inner area and used to fix the merchandise. Finally it is possible to fix a strip of material, e.g. cardboard, on the merchandise. This can be done by adhesive strips or by squeezing it into a slotlike opening on the merchandise, for example by a cardboard strip fixed between the housing and the lamp field cover of a lamp. Such a strip of material protrudes from the merchandise and serves as a support for the inner area of the package. In any case the package cooperates with a support produced or already present on the merchandise.

Alternatively the inner area of the inventive merchandise package can also be formed as a strip of material that engages an opening in the merchandise to be packaged with a stamped-out or laterally protruding flap and is fixed therein. If the merchandise is a long field lamp this can be for example the slot between lamp housing and lamp cover which such a flap engages and in which it is clamped.

According to a further embodiment the inner area has a stamped hole or opening, preferably in the area of the bottom segment, which a projection on the merchandise to be packaged can engage to fix the merchandise within this inner area. In this case it is expedient to design the inner area analogously to the outer area so that it can be folded into a box open at the end.

The inner area of the inventive merchandise package is preferably designed so that after being folded back it is completely covered by the box formed by the outer area and thus cannot be seen. Also, the inner area with the merchandise is surrounded so closely by the outer area that the locking elements cannot come apart.

Preferred materials for the inventive merchandise package are paper, cardboard or combinations thereof.

The object of the invention is also a cut for the inventive merchandise package and the merchandise package itself together with the contained merchandise, in particular a long field lamp.

The invention will be explained in more detail by the enclosed figures, in which unbroken lines represent cut or stamped edges and broken lines represent fold edges.

DESCRIPTION OF THE PREFERRED EMBODIMENTS

Figure 1:
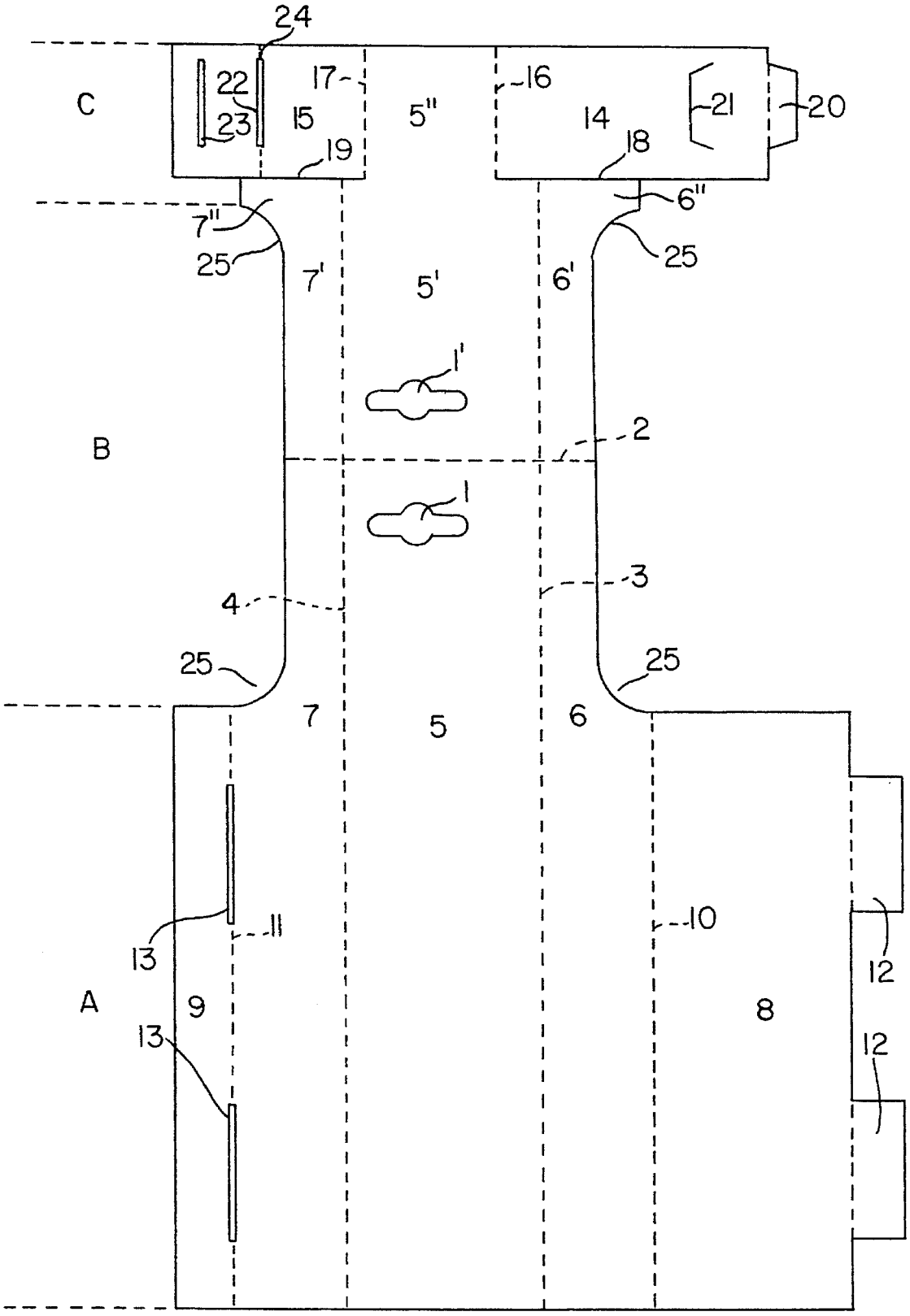
FIG. 1 shows a material cut that can be folded into an inventive merchandise package.

The material cut according to FIG. 1 for an inventive merchandise package shows outer area A, head area B and inner area C. Head area B has two stamped holes 1, 1' that are disposed mirror-symmetrically to cross fold 2. Two longitudinal folds 3 and 4 delimit bottom segments 5, 5' of the outer and head areas from side segments 6, 7 and 6', 7'. The side segments extend over total outer area A and head area B into inner area C.

Outer area A has cover segment 8 adjacent side segment 6 and holding segment 9 bordering side segment 7, which are delimited from side segments 6, 7 by fold lines 10, 11. Cover segment 8 furthermore has two flaps 12 on the side opposite side segment 6 that are to be inserted in corresponding slots 13 in the area of folded seam 11 between side segment 7 and holding segment 9.

Inner area C includes end areas 6" and 7" of the side segments and 5" of the bottom segment and has two belt- or band-shaped segments 14 and 15 that can be delimited from the end area of bottom segment 5" by fold lines 16, 17. Segments 14 and 15 are separated from side segments 6" and 7" by incisions 18 and 19, these incisions continuing into end area 5" of the bottom segment. Two opposing flaps 20, 21, flap 21 being stamped out of segment 14, correspond with two slots 22 and 23 in segment 15. Slot 22 can extend along fold line 24 that divides segment 15.

For the merchandise to be packaged the cut is folded back along fold line 2 so that stamped hole 1' comes to lie on stamped hole 1, and bottom segments 5' and 5" on bottom segment 5. The merchandise to be packaged is then placed on bottom segments 5, 5' and 5" and fixed with the aid of segments 14 and 15 that are placed around the merchandise and secured with the aid of flaps 20, 21 in slots 22, 23. When the package is open at the bottom the merchandise is secured by the tight-fitting band formed by segments 5", 14 and 15 acting against a projection. In the case of a long field lamp this is preferably a foot or the like in the bottom area that serves to support such a lamp on a fastening surface. The merchandise can accordingly be secured against removal from above by a projection located below the band. Other securing measures are possible.

Side segments 6 and 7 of the merchandise package are then put up along fold lines 3 and 4, holding segment 9 folded in, and cover segment 8 put across and secured with flaps 12 in slots 13, resulting in a folded box open at the top and bottom that surrounds the merchandise over part of its length. This folded or outer box at the same time secures the band formed from bottom segment 5" and segments 14 and 15.

It is particularly advantageous with this design of the merchandise package that a print on one side is completely sufficient for design. If the back (not shown) is printed all visible parts of the merchandise package are formed by printed parts when the package is closed; the unprinted inside is either covered by the part of head area B turned over on the front or located inside the box formed by area A.

It has proven expedient to deepen side segments 6, 6', 6" or 7, 7', 7" in head area B and to provide the transitions to outer area A and to inner area C with curves 25. This firstly improves the appearance since the head area of the merchandise can be better seen, and at the same time preserves stability since it avoids the increased danger of tearing under load that exists in the area of right-angled incisions when cardboard is used as a packaging material.

Figure 2:
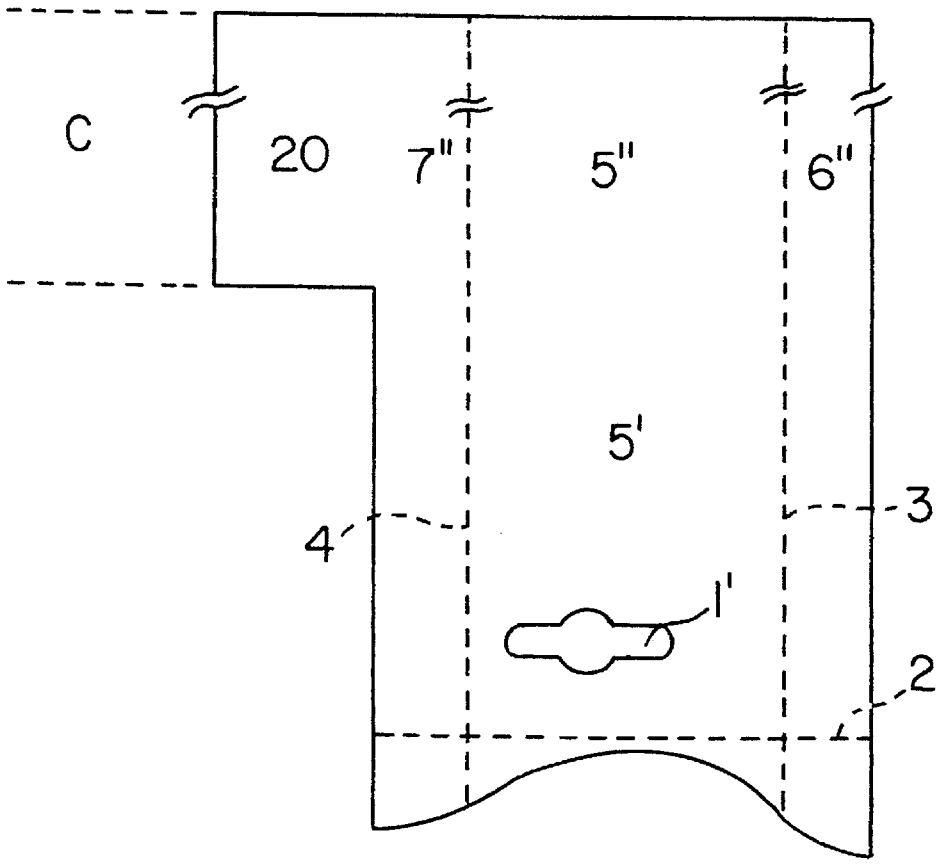
FIG. 2 shows a variant of the material cut of FIG. 1 with a different design of the inner area.

FIG. 2 shows a further embodiment of the inventive merchandise package with inner area C differing from FIG. 1. The inner area here comprises end areas 5", 6" and 7" of the bottom segment and the side segments and a flap connected to side segment 7" (or accordingly 6" ) that is introduced into a slot in the merchandise to be packaged and can be clamped there. This can be done successfully on long field lamps for example that have a cover for the lamp field placed on the lamp housing and clamped thereon.

Figure 3:
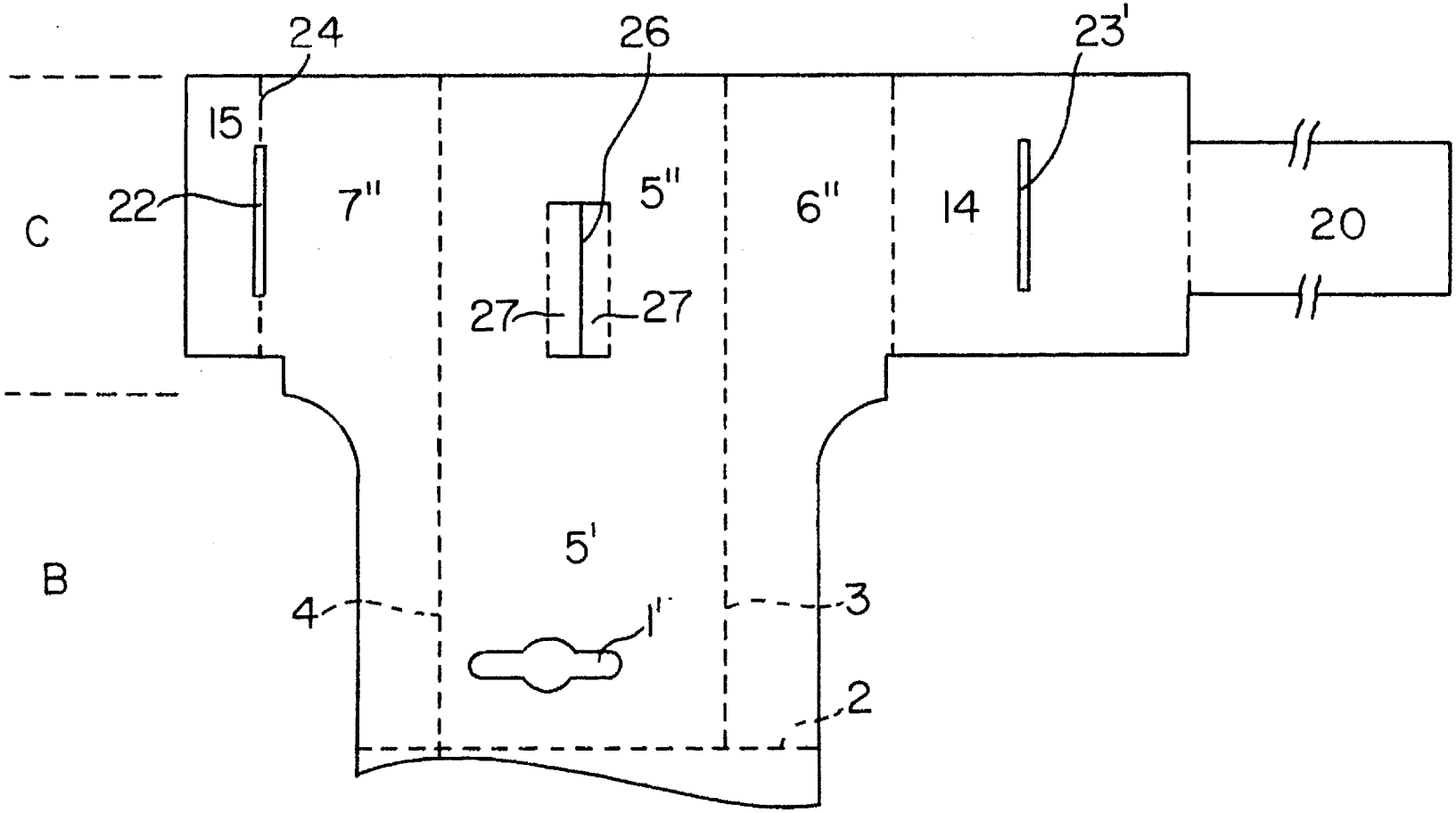
FIG. 3 shows a further variant of the material cut of FIG. 1 with respect to the design of the inner area.

FIG. 3 shows a further embodiment of inner area C that is designed like outer area A as a box to be folded around the package, the bottom and the side segments being formed as hitherto by segments 5", 6" and 7", segment 14 forming the cover, segment 15 a holding segment or support, and flap 20 being introduced into slot 22 between side wall 7" and holding segment 15. Flap 20 is then drawn back onto segment 14 and inserted into slot 23'. Stamping 26 in the form of a double T disposed in end area 5" of the bottom segment and forming outwardly opening wings or doors 27 when the merchandise is inserted is suitable for taking up and fixing a projection in the bottom area of the merchandise to be packaged. When the merchandise is closely embraced by inner area C and this mount additionally fixed by the box formed by outer area A it is virtually impossible for the merchandise to slip out, being supported in stamping 26 against bottom segment 5". Obviously such a stamping is coordinated with the dimensions of the projection on the merchandise to be received therein.

Figure 4:
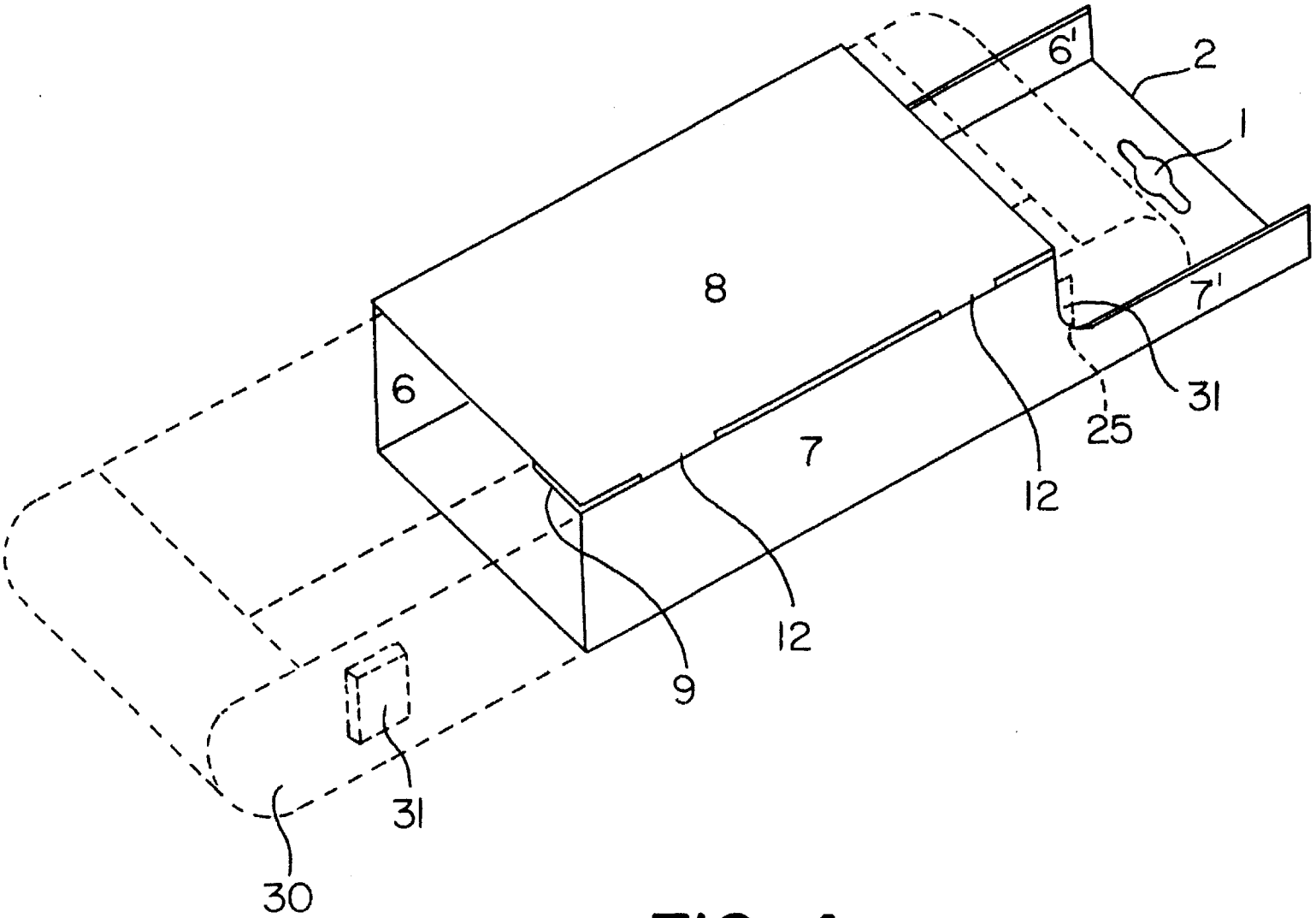
FIG. 4 shows the inventive merchandise package according to FIG. 1 in a folded state with a (suggested) lamp disposed therein.

FIG. 4 shows an assembled merchandise package with the folded box formed by outer area A, head area B folded back on itself along fold 2 with stamped hole 1 and long field lamp 30 packaged therein (indicated by broken lines). Inner area C in the form of the band placed around the merchandise is located inside the folded box formed by outer area A. One can see foot 31 of the lamp that is supported on the band edge on the head side.

I claim:

1. A merchandise package, including a stamped hole for taking up a merchandise holder, comprising an outer area that can be folded into a box surrounding the merchandise to be packaged over at least part of its length, the outer area comprising two side segments and a cover segment, the outer area capable of being folded along fold line, into a rectangular box open at the end, a head area that can be folded back on itself along a cross fold and includes two stamped holes disposed mirror-symmetrically to the cross fold for taking up a merchandise holder, side segments that continue from the outer area into the head area, and an inner area adjacent the head area that can be folded back with the head area and comes to lie within the box formed by the outer area and can be connected supportingly with the merchandise to be packaged.

2. The merchandise package of claim 1, wherein the outer area further comprises flaps and slots with which the box can be secured.

3. The merchandise package of claims 1 or 2, wherein the inner area comprises belt- or band-shaped segments that can be closed into a band.

4. The merchandise package of claim 3, wherein the band is lockable via flaps and slots, the flaps being provided on one of the segments and the slots on the other segment.

5. The merchandise package of claim 4, wherein one of the segments of the band has two flaps whose ends point away from each other and can be inserted into the slots of the other segment.

6. The merchandise package of claims 1 or 2, wherein the package is made of cardboard.

7. The merchandise package of claims 1 or 2, wherein the package is in the form of a printed or unprinted cut.

8. The merchandise package of claims 1 or 2, wherein the package contains merchandise.

9. The merchandise package of claim 1, wherein the package contains a long field lamp.

10. The merchandise package of claim 5, wherein the belt- or band-shaped segments comprise a first belt- or band-shaped segment and a second belt- or band-shaped segment, the first belt- or band-shaped segment includes a flap that can be stuck through a slot in the second belt- or band-shaped segment and inserted in a further slot in the first belt- or band-shaped segment.

11. The merchandise package of claims 1 or 2, wherein the inner area is designed as a prolongation of the head area that includes a lateral flap suitable for fixing in or on the merchandise to be packaged.

12. The merchandise package of claims 1, 2 or 9, wherein the inner area includes a bottom segment comprising a stamping which a projection on the merchandise to be packaged can engage.

13. The merchandise package of claim 12, wherein the stamping is formed as a double T with two wings that open up.

* * * * *